US008113875B2

(12) United States Patent
Malloy et al.

(10) Patent No.: US 8,113,875 B2
(45) **Date of Patent: *Feb. 14, 2012**

(54) CABLE CONNECTOR

(75) Inventors: Allen L. Malloy, Elmira Heights, NY (US); Charles Thomas, Athens, PA (US); Mike Dean, Waverly, NY (US); Bruce Hauver, Sr., Elmira, NY (US)

(73) Assignee: Belden Inc., St. Louis, MO (US)

( * ) Notice: Subject to any disclaimer, the term of this patent is extended or adjusted under 35 U.S.C. 154(b) by 134 days.

This patent is subject to a terminal disclaimer.

(21) Appl. No.: 12/568,149

(22) Filed: Sep. 28, 2009

(65) Prior Publication Data

US 2011/0117774 A1 May 19, 2011

Related U.S. Application Data

(60) Provisional application No. 61/101,185, filed on Sep. 30, 2008, provisional application No. 61/101,191, filed on Sep. 30, 2008, provisional application No. 61/155,246, filed on Feb. 25, 2009, provisional application No. 61/155,249, filed on Feb. 25, 2009, provisional application No. 61/155,250, filed on Feb. 25, 2009, provisional application No. 61/155,252, filed on Feb. 25, 2009, provisional application No. 61/155,289, filed on Feb. 25, 2009, provisional application No. 61/155,297, filed on Feb. 25, 2009, provisional application No. 61/175,613, filed on May 5, 2009, provisional application No. 61/242,884, filed on Sep. 16, 2009.

(51) Int. Cl.
*H01R 9/05* (2006.01)

(52) U.S. Cl. ..... 439/578

(58) Field of Classification Search ..... 439/578, 439/63, 584
See application file for complete search history.

(56) References Cited

U.S. PATENT DOCUMENTS

| | | | |
|---|---|---|---|
| 1,734,506 | A | 11/1929 | Walter |
| 2,258,737 | A | 10/1941 | Browne |
| 2,394,351 | A | 2/1946 | Wurzburger |
| 2,460,304 | A | 2/1949 | McGee et al. |
| 2,544,654 | A | 3/1951 | Brown |
| 2,544,764 | A | 3/1951 | Parkes |

(Continued)

FOREIGN PATENT DOCUMENTS

| | | |
|---|---|---|
| CA | 2096710 | 11/1994 |

(Continued)

OTHER PUBLICATIONS

Notice of Allowance for U.S. Appl. No. 12/568,160, mail date Apr. 18, 2011, 8 pages.

(Continued)

*Primary Examiner* — Jean F Duverne
(74) *Attorney, Agent, or Firm* — Foley & Lardner LLP

(57) ABSTRACT

A coaxial cable connector for coupling a coaxial cable to a mating connector includes a connector body having a forward end and a rearward cable receiving end for receiving a cable. A nut is rotatably coupled to the forward end of the connector body. An annular post is disposed within the connector body, the annular post having a forward flanged base portion located adjacent a rearward portion of the nut. An annular notch is formed in the forward flanged base portion. A biasing element is retained in the annular notch, and the biasing element extends towards a forward end of the nut in an uncompressed state.

24 Claims, 8 Drawing Sheets

U.S. PATENT DOCUMENTS

| | | | |
|---|---|---|---|
| 2,549,647 | A | 4/1951 | Turenne |
| 2,694,187 | A | 11/1954 | Nash |
| 2,728,895 | A | 12/1955 | Quackenbush et al. |
| 2,754,487 | A | 7/1956 | Carr et al. |
| 2,757,351 | A | 7/1956 | Klostermann |
| 2,761,110 | A | 8/1956 | Edlen et al. |
| 2,762,025 | A | 9/1956 | Melcher |
| 2,805,399 | A | 9/1957 | Leeper |
| 2,870,420 | A | 1/1959 | Malek |
| 2,983,893 | A | 5/1961 | Jackson |
| 2,999,701 | A | 9/1961 | Blair et al. |
| 3,040,288 | A | 6/1962 | Edlen et al. |
| 3,184,706 | A | 5/1965 | Atkins |
| 3,196,382 | A | 7/1965 | Morello, Jr. |
| 3,206,540 | A | 9/1965 | Cohen |
| 3,245,027 | A | 4/1966 | Ziegler, Jr. |
| 3,275,913 | A | 9/1966 | Blanchard et al. |
| 3,275,970 | A | 9/1966 | Johanson et al. |
| 3,292,136 | A | 12/1966 | Somerset |
| 3,295,076 | A | 12/1966 | Kraus |
| 3,297,979 | A | 1/1967 | O'Keefe et al. |
| 3,320,575 | A | 5/1967 | Brown et al. |
| 3,336,562 | A | 8/1967 | McCormick et al. |
| 3,350,677 | A | 10/1967 | Daum |
| 3,355,698 | A | 11/1967 | Keller |
| 3,373,243 | A | 3/1968 | Janowiak et al. |
| 3,384,703 | A | 5/1968 | Forney, Jr. et al. |
| 3,406,373 | A | 10/1968 | Forney, Jr. et al. |
| 3,448,430 | A | 6/1969 | Kelly |
| 3,465,281 | A | 9/1969 | Florer |
| 3,467,940 | A | 9/1969 | Wallo |
| 3,475,545 | A | 10/1969 | Stark et al. |
| 3,498,647 | A | 3/1970 | Schroder |
| 3,526,871 | A | 9/1970 | Hobart |
| 3,533,051 | A | 10/1970 | Ziegler, Jr. |
| 3,537,065 | A | 10/1970 | Winston |
| 3,538,464 | A | 11/1970 | Walsh |
| 3,544,705 | A | 12/1970 | Winston |
| 3,551,882 | A | 12/1970 | O'Keefe |
| 3,564,487 | A | 2/1971 | Upstone et al. |
| 3,573,677 | A | 4/1971 | Detar |
| 3,579,155 | A | 5/1971 | Tuchto |
| 3,591,208 | A | 7/1971 | Nicolaus |
| 3,594,694 | A | 7/1971 | Clark |
| 3,613,050 | A | 10/1971 | Andrews |
| 3,629,792 | A | 12/1971 | Dorrell |
| 3,633,150 | A | 1/1972 | Swartz |
| 3,633,944 | A | 1/1972 | Hamburg |
| 3,644,874 | A | 2/1972 | Hutter |
| 3,646,502 | A | 2/1972 | Hutter et al. |
| 3,663,926 | A | 5/1972 | Brandt |
| 3,668,612 | A | 6/1972 | Nepovim |
| 3,669,472 | A | 6/1972 | Nadsady |
| 3,671,922 | A | 6/1972 | Zerlin et al. |
| 3,684,321 | A | 8/1972 | Hundhausen et al. |
| 3,686,623 | A | 8/1972 | Nijman |
| 3,694,792 | A | 9/1972 | Wallo |
| 3,710,005 | A | 1/1973 | French |
| 3,721,869 | A | 3/1973 | Paoli |
| 3,743,979 | A | 7/1973 | Schor |
| 3,745,514 | A | 7/1973 | Brishka |
| 3,778,535 | A | 12/1973 | Forney, Jr. |
| 3,781,762 | A | 12/1973 | Quackenbush |
| 3,808,580 | A | 4/1974 | Johnson |
| 3,836,700 | A | 9/1974 | Niemeyer |
| 3,845,453 | A | 10/1974 | Hemmer |
| 3,846,738 | A | 11/1974 | Nepovim |
| 3,854,003 | A | 12/1974 | Duret |
| 3,870,978 | A | 3/1975 | Dreyer |
| 3,879,102 | A | 4/1975 | Horak |
| 3,907,399 | A | 9/1975 | Spinner |
| 3,910,673 | A | 10/1975 | Stokes |
| 3,915,539 | A | 10/1975 | Collins |
| 3,936,132 | A | 2/1976 | Hutter |
| 3,953,097 | A | 4/1976 | Graham |
| 3,953,098 | A | 4/1976 | Avery et al. |
| 3,961,294 | A | 6/1976 | Hollyday |
| 3,963,320 | A | 6/1976 | Spinner |
| 3,972,013 | A | 7/1976 | Shapiro |
| 3,976,352 | A | 8/1976 | Spinner |
| 3,980,805 | A | 9/1976 | Lipari |
| 3,985,418 | A | 10/1976 | Spinner |
| 4,012,105 | A | 3/1977 | Biddle |
| 4,017,139 | A | 4/1977 | Nelson |
| 4,046,451 | A | 9/1977 | Juds et al. |
| 4,051,447 | A | 9/1977 | Heckman, Jr. et al. |
| 4,053,200 | A | 10/1977 | Pugner |
| 4,059,330 | A | 11/1977 | Shirey |
| 4,093,335 | A | 6/1978 | Schwartz et al. |
| 4,126,372 | A | 11/1978 | Hashimoto et al. |
| 4,131,332 | A | 12/1978 | Hogendobler et al. |
| 4,150,250 | A | 4/1979 | Lundeberg |
| 4,156,554 | A | 5/1979 | Aujla |
| 4,165,911 | A | 8/1979 | Laudig |
| 4,168,921 | A | 9/1979 | Blanchard |
| 4,172,385 | A | 10/1979 | Cristensen |
| 4,173,385 | A | 11/1979 | Fenn et al. |
| 4,187,481 | A | 2/1980 | Boutros |
| 4,191,408 | A | 3/1980 | Acker |
| 4,225,162 | A | 9/1980 | Dola |
| 4,227,765 | A | 10/1980 | Neumann et al. |
| 4,235,461 | A | 11/1980 | Normack |
| 4,250,348 | A | 2/1981 | Kitagawa |
| 4,255,011 | A | 3/1981 | Davis et al. |
| 4,258,943 | A | 3/1981 | Vogt et al. |
| 4,280,749 | A | 7/1981 | Hemmer |
| 4,339,166 | A | 7/1982 | Dayton |
| 4,346,958 | A | 8/1982 | Blanchard |
| 4,354,721 | A | 10/1982 | Luzzi |
| 4,358,174 | A | 11/1982 | Dreyer |
| 4,373,767 | A | 2/1983 | Cairns |
| 4,400,050 | A | 8/1983 | Hayward |
| 4,406,483 | A | 9/1983 | Perlman |
| 4,407,529 | A | 10/1983 | Holman |
| 4,408,821 | A | 10/1983 | Forney, Jr. |
| 4,408,822 | A | 10/1983 | Nikitas |
| 4,421,377 | A | 12/1983 | Spinner |
| 4,426,127 | A | 1/1984 | Kubota |
| 4,444,453 | A | 4/1984 | Kirby et al. |
| 4,456,323 | A | 6/1984 | Pitcher et al. |
| 4,462,653 | A | 7/1984 | Flederbach et al. |
| 4,464,000 | A | 8/1984 | Werth et al. |
| 4,484,792 | A | 11/1984 | Tengler et al. |
| 4,515,427 | A | 5/1985 | Smit |
| 4,533,191 | A | 8/1985 | Blackwood |
| 4,540,231 | A | 9/1985 | Forney, Jr. |
| 4,545,633 | A | 10/1985 | McGeary |
| 4,545,637 | A | 10/1985 | Bosshard et al. |
| 4,557,546 | A | 12/1985 | Dreyer |
| 4,561,716 | A | 12/1985 | Acke |
| 4,575,274 | A | 3/1986 | Hayward |
| 4,583,811 | A | 4/1986 | McMills |
| 4,588,246 | A | 5/1986 | Schildkraut et al. |
| 4,593,964 | A | 6/1986 | Forney, Jr. et al. |
| 4,596,434 | A | 6/1986 | Saba et al. |
| 4,596,435 | A | 6/1986 | Bickford |
| 4,597,620 | A | 7/1986 | Lindner et al. |
| 4,598,961 | A | 7/1986 | Cohen |
| 4,600,263 | A | 7/1986 | DeChamp et al. |
| 4,613,119 | A | 9/1986 | Hardtke |
| 4,614,390 | A | 9/1986 | Baker |
| 4,632,487 | A | 12/1986 | Wargula |
| 4,640,572 | A | 2/1987 | Conlon |
| 4,645,281 | A | 2/1987 | Burger |
| 4,650,228 | A | 3/1987 | McMills et al. |
| 4,655,159 | A | 4/1987 | McMills |
| 4,660,921 | A | 4/1987 | Hauver |
| 4,668,043 | A | 5/1987 | Saba et al. |
| 4,674,818 | A | 6/1987 | McMills et al. |
| 4,676,577 | A | 6/1987 | Szegda |
| 4,682,832 | A | 7/1987 | Punako et al. |
| 4,688,876 | A | 8/1987 | Morelli |
| 4,688,878 | A | 8/1987 | Cohen et al. |
| 4,691,976 | A | 9/1987 | Cowen |
| 4,703,987 | A | 11/1987 | Gallusser et al. |
| 4,703,988 | A | 11/1987 | Raux et al. |
| 4,717,355 | A | 1/1988 | Mattis |

4,738,009 A 4/1988 Down et al.
4,746,305 A 5/1988 Nomura
4,747,786 A 5/1988 Hayashi et al.
4,755,152 A 7/1988 Elliot et al.
4,759,729 A 7/1988 Kemppainen et al.
4,761,146 A 8/1988 Sohoel
4,772,222 A 9/1988 Laudig et al.
4,777,669 A 10/1988 Rogus
4,789,355 A 12/1988 Lee
4,793,821 A 12/1988 Fowler et al.
4,806,116 A 2/1989 Ackerman
4,808,128 A 2/1989 Werth
4,813,886 A 3/1989 Roos et al.
4,820,185 A 4/1989 Moulin
4,824,400 A 4/1989 Spinner
4,834,675 A 5/1989 Samchisen
4,854,893 A 8/1989 Morris
4,857,014 A 8/1989 Alf et al.
4,869,679 A 9/1989 Szegda
4,874,331 A 10/1989 Iverson
4,878,697 A 11/1989 Henry
4,892,275 A 1/1990 Szegda
4,902,246 A 2/1990 Samchisen
4,906,207 A 3/1990 Banning et al.
4,915,651 A 4/1990 Bout
4,923,412 A 5/1990 Morris
4,925,403 A 5/1990 Zorey
4,927,385 A 5/1990 Cheng
4,929,188 A 5/1990 Lionetto et al.
4,941,846 A 7/1990 Guimond et al.
4,952,174 A 8/1990 Sucht et al.
4,957,456 A 9/1990 Olson et al.
4,973,265 A 11/1990 Heeren
4,979,911 A 12/1990 Spencer
4,990,104 A 2/1991 Schieferly
4,990,105 A 2/1991 Karlovich
4,990,106 A 2/1991 Szegda
4,992,061 A 2/1991 Brush, Jr. et al.
5,002,503 A 3/1991 Campbell et al.
5,007,861 A 4/1991 Stirling
5,021,010 A 6/1991 Wright
5,024,606 A 6/1991 Ming-Hwa
5,037,328 A 8/1991 Karlovich
5,062,804 A 11/1991 Jamet et al.
5,066,248 A 11/1991 Gaver, Jr. et al.
5,073,129 A 12/1991 Szegda
5,083,943 A 1/1992 Tarrant
5,100,341 A 3/1992 Czyz et al.
5,120,260 A 6/1992 Jackson
5,127,853 A 7/1992 McMills et al.
5,131,862 A 7/1992 Gershfeld
5,141,451 A 8/1992 Down
5,154,636 A 10/1992 Vaccaro et al.
5,161,993 A 11/1992 Leibfried, Jr.
5,192,219 A 3/1993 Fowler et al.
5,195,906 A 3/1993 Szegda
5,205,761 A 4/1993 Nilsson
5,207,602 A 5/1993 McMills et al.
5,217,391 A 6/1993 Fisher, Jr.
5,217,393 A 6/1993 Del Negro et al.
5,269,701 A 12/1993 Leibfried, Jr.
5,280,254 A 1/1994 Hunter et al.
5,281,167 A 1/1994 Le et al.
5,283,853 A 2/1994 Szegda
5,284,449 A 2/1994 Vaccaro
5,316,494 A 5/1994 Flanagan et al.
5,316,499 A 5/1994 Scannelli et al.
5,318,459 A 6/1994 Shields
5,338,225 A 8/1994 Jacobsen et al.
5,342,218 A 8/1994 McMills et al.
5,354,217 A 10/1994 Gabel et al.
5,371,819 A 12/1994 Szegda
5,371,821 A 12/1994 Szegda
5,371,827 A 12/1994 Szegda
5,393,244 A 2/1995 Szegda
5,409,398 A 4/1995 Chadbourne et al.
5,417,588 A 5/1995 Olson et al.
5,431,583 A 7/1995 Szegda
5,435,745 A 7/1995 Booth
5,444,810 A 8/1995 Szegda
5,455,548 A 10/1995 Grandchamp et al.
5,456,611 A 10/1995 Henry et al.
5,456,614 A 10/1995 Szegda
5,466,173 A 11/1995 Down
5,470,257 A 11/1995 Szegda
5,490,033 A 2/1996 Cronin
5,494,454 A 2/1996 Johnsen
5,496,076 A 3/1996 Lin
5,501,616 A 3/1996 Holliday
5,525,076 A 6/1996 Down
5,542,861 A 8/1996 Anhalt et al.
5,548,088 A 8/1996 Gray et al.
5,550,521 A 8/1996 Bernaud et al.
5,571,028 A 11/1996 Szegda
5,586,910 A 12/1996 Del Negro et al.
5,595,502 A 1/1997 Allison
5,598,132 A 1/1997 Stabile
5,607,325 A 3/1997 Toma
5,620,339 A 4/1997 Gray et al.
5,632,651 A 5/1997 Szegda
5,651,699 A 7/1997 Holliday
5,653,605 A 8/1997 Woehl et al.
5,667,405 A 9/1997 Holliday
5,683,263 A 11/1997 Hsu
5,690,503 A 11/1997 Konda et al.
5,695,365 A 12/1997 Kennedy et al.
5,702,262 A 12/1997 Brown et al.
5,702,263 A 12/1997 Baumann et al.
5,769,652 A 6/1998 Wider
5,775,927 A 7/1998 Wider
5,879,191 A 3/1999 Burris
5,882,226 A 3/1999 Bell et al.
5,956,365 A 9/1999 Haissig
5,967,852 A 10/1999 Follingstad et al.
5,975,949 A 11/1999 Holliday et al.
5,975,951 A 11/1999 Burris et al.
5,997,350 A 12/1999 Burris et al.
6,019,636 A 2/2000 Langham
6,032,358 A 3/2000 Wild
6,042,422 A 3/2000 Youtsey
6,089,903 A 7/2000 Stafford Gray et al.
6,089,912 A 7/2000 Tallis et al.
6,089,913 A 7/2000 Holliday
6,106,314 A 8/2000 McLean et al.
6,123,581 A 9/2000 Stabile et al.
6,146,197 A 11/2000 Holliday et al.
6,153,830 A 11/2000 Montena
6,168,211 B1 1/2001 Schorn-Gilson
6,210,222 B1 4/2001 Langham et al.
6,217,383 B1 4/2001 Holland et al.
RE37,153 E 5/2001 Henszey et al.
6,241,553 B1 6/2001 Hsia
6,261,126 B1 7/2001 Stirling
6,344,736 B1 2/2002 Kerrigan et al.
6,358,077 B1 3/2002 Young
6,390,825 B1 5/2002 Handley et al.
D458,904 S 6/2002 Montena
D460,739 S 7/2002 Fox
D460,740 S 7/2002 Montena
D460,946 S 7/2002 Montena
D460,947 S 7/2002 Montena
D460,948 S 7/2002 Montena
D461,166 S 8/2002 Montena
D461,167 S 8/2002 Montena
D461,778 S 8/2002 Fox
D462,058 S 8/2002 Montena
D462,060 S 8/2002 Fox
D462,327 S 9/2002 Montena
6,478,618 B2 11/2002 Wong
6,491,546 B1 12/2002 Perry
D468,696 S 1/2003 Montena
6,558,194 B2 5/2003 Montena
6,561,841 B2 5/2003 Norwood et al.
6,619,876 B2 9/2003 Vaitkus et al.
6,621,386 B2 9/2003 Drackner et al.
6,692,285 B2 2/2004 Islam
6,712,631 B1 3/2004 Youtsey
6,716,062 B1 4/2004 Palinkas et al.

| | | | | |
|---|---|---|---|---|
| 6,733,337 | B2 | 5/2004 | Kodaira | |
| 6,767,248 | B1 | 7/2004 | Hung | |
| 6,805,584 | B1 | 10/2004 | Chen | |
| 6,817,896 | B2 | 11/2004 | Derenthal | |
| 6,830,479 | B2 | 12/2004 | Holliday | |
| 6,848,940 | B2 | 2/2005 | Montena | |
| 6,910,910 | B2 | 6/2005 | Cairns | |
| 6,921,283 | B2 | 7/2005 | Zahlit et al. | |
| 6,939,169 | B2 | 9/2005 | Islam et al. | |
| 7,114,990 | B2 | 10/2006 | Bence et al. | |
| 7,189,097 | B2 | 3/2007 | Benham | |
| 7,192,308 | B2 | 3/2007 | Rodrigues et al. | |
| 7,473,128 | B2 | 1/2009 | Montena | |
| 7,566,236 | B2 | 7/2009 | Malloy et al. | |
| 7,587,244 | B2 | 9/2009 | Olbertz | |
| 7,753,705 | B2 | 7/2010 | Montena | |
| 7,828,595 | B2 | 11/2010 | Mathews | |
| 7,833,053 | B2 | 11/2010 | Mathews | |
| 2002/0013088 | A1 | 1/2002 | Rodrigues et al. | |
| 2004/0048514 | A1 | 3/2004 | Kodaira | |
| 2004/0077215 | A1 | 4/2004 | Palinkas et al. | |
| 2004/0102089 | A1 | 5/2004 | Chee | |
| 2004/0224552 | A1 | 11/2004 | Hagmann et al. | |
| 2004/0229504 | A1 | 11/2004 | Liu | |
| 2005/0042919 | A1 | 2/2005 | Montena | |
| 2005/0164553 | A1 | 7/2005 | Montena | |
| 2005/0208827 | A1 | 9/2005 | Burris et al. | |
| 2006/0110977 | A1 | 5/2006 | Matthews | |
| 2008/0102696 | A1 | 5/2008 | Montena | |
| 2008/0113554 | A1 | 5/2008 | Montena | |
| 2008/0311790 | A1 | 12/2008 | Malloy et al. | |
| 2010/0081321 | A1 * | 4/2010 | Malloy et al. | 439/578 |
| 2010/0081322 | A1 * | 4/2010 | Malloy et al. | 439/578 |

FOREIGN PATENT DOCUMENTS

| | | | |
|---|---|---|---|
| DE | 47931 | | 10/1888 |
| DE | 1 117 687 | | 11/1961 |
| DE | 1 515 398 | | 11/1962 |
| DE | 1 191 880 | | 4/1965 |
| DE | 2 221 936 | | 5/1972 |
| DE | 2 225 764 | | 5/1972 |
| DE | 2 261 973 | | 12/1972 |
| DE | 32 11 008 | A1 | 10/1983 |
| DE | 102289 | | 7/1987 |
| DE | 41 28 551 | A1 | 3/1992 |
| EP | 0 072 104 | | 2/1983 |
| EP | 0 116 157 | | 8/1984 |
| EP | 0 167 738 | | 1/1986 |
| EP | 0 265 276 | B1 | 4/1988 |
| FR | 2 232 846 | | 6/1974 |
| FR | 2 234 680 | | 6/1974 |
| FR | 2 462 798 | | 2/1980 |
| FR | 4 494 508 | | 5/1982 |
| FR | 2 524 722 | | 10/1983 |
| GB | 589697 | | 3/1945 |
| GB | 1087228 | | 10/1967 |
| GB | 1 270 846 | | 4/1972 |
| GB | 2 019 665 | A | 10/1979 |
| GB | 2 079 549 | A | 1/1982 |
| GB | 2 331 634 | A | 5/1999 |
| JP | 03071571 | | 3/1991 |
| JP | 03-280369 | | 12/1991 |
| JP | 10-228948 | | 8/1998 |
| JP | 2002075556 | | 3/2002 |
| WO | WO 93/24973 | | 12/1993 |
| WO | WO 96/08854 | | 3/1996 |
| WO | WO 01/86756 | A1 | 11/2001 |

OTHER PUBLICATIONS

Notice of Allowance for U.S. Appl. No. 12/568,179, mail date Mar. 21, 2011, 10 pages.

Office Action for U.S. Appl. No. 12/568,160, mail date Jul. 22, 2010, 7 pages.

Office Action for U.S. Appl. No. 12/568,160, mail date Sep. 8, 2010, 10 pages.

Response to Office Action for U.S. Appl. No. 12/568,160, filed Aug. 23, 2010, 3 pages.

Response to Office Action for U.S. Appl. No. 12/568,160, filed Mar. 7, 2011, 37 pages.

Statement of Substance of Interview, Terminal Disclaimer and Statement Under 37 CFR 3.73(b) for U.S. Appl. No. 12/568,179, filed Jun. 30, 2011, 5 pages.

* cited by examiner

CABLE CONNECTOR

CROSS-REFERENCE TO RELATED APPLICATIONS

This application claims priority under 35. U.S.C. §119, based on U.S. Provisional Patent Application Nos. 61/101,185 filed Sep. 30, 2008, 61/101,191, filed Sep. 30, 2008, 61/155,246, filed Feb. 25, 2009, 61/155,249, filed Feb. 25, 2009, 61/155,250, filed Feb. 25, 2009, 61/155,252, filed Feb. 25, 2009, 61/155,289, filed Feb. 25, 2009, 61/155,297, filed Feb. 25, 2009, 61/175,613, filed May 5, 2009, and 61/242,884, filed Sep. 16, 2009, the disclosures of which are all hereby incorporated by reference herein.

The present application is also related to co-pending U.S. patent application Ser. Nos. 12/568,160, entitled "Cable Connector," filed, Sep. 28, 2009, and U.S. patent application Ser. No. 12/568,179, entitled "Cable Connector," filed Sep. 28, 2009, the disclosures of which are both hereby incorporated by reference herein.

BACKGROUND OF THE INVENTION

Connectors are used to connect coaxial cables to various electronic devices such as televisions, antennas, set-top boxes, satellite television receivers, etc. Conventional coaxial connectors generally include a connector body having an annular collar for accommodating a coaxial cable, and an annular nut rotatably coupled to the collar for providing mechanical attachment of the connector to an external device and an annular post interposed between the collar and the nut. The annular collar that receives the coaxial cable includes a cable receiving end for insertably receiving a coaxial cable and, at the opposite end of the connector body, the annular nut includes an internally threaded end that permits screw threaded attachment of the body to an external device.

This type of coaxial connector also typically includes a locking sleeve to secure the cable within the body of the coaxial connector. The locking sleeve, which is typically formed of a resilient plastic, is securable to the connector body to secure the coaxial connector thereto. In this regard, the connector body typically includes some form of structure to cooperatively engage the locking sleeve. Such structure may include one or more recesses or detents formed on an inner annular surface of the connector body, which engages cooperating structure formed on an outer surface of the sleeve.

Conventional coaxial cables typically include a center conductor surrounded by an insulator. A conductive foil is disposed over the insulator and a braided conductive shield surrounds the foil-covered insulator. An outer insulative jacket surrounds the shield. In order to prepare the coaxial cable for termination with a connector, the outer jacket is stripped back exposing a portion of the braided conductive shield. The exposed braided conductive shield is folded back over the jacket. A portion of the insulator covered by the conductive foil extends outwardly from the jacket and a portion of the center conductor extends outwardly from within the insulator.

Upon assembly, a coaxial cable is inserted into the cable receiving end of the connector body and the annular post is forced between the foil covered insulator and the conductive shield of the cable. In this regard, the post is typically provided with a radially enlarged barb to facilitate expansion of the cable jacket. The locking sleeve is then moved axially into the connector body to clamp the cable jacket against the post barb providing both cable retention and a water-tight seal around the cable jacket. The connector can then be attached to an external device by tightening the internally threaded nut to an externally threaded terminal or port of the external device.

The Society of Cable Telecommunication Engineers (SCTE) provides values for the amount of torque recommended for connecting such coaxial cable connectors to various external devices. Indeed, most cable television (CATV), multiple systems operator (MSO), satellite and telecommunication providers also require their installers to apply a torque requirement of 25 to 30 in/lb to secure the fittings against the interface (reference plane). The torque requirement prevents loss of signals (egress) or introduction of unwanted signals (ingress) between the two mating surfaces of the male and female connectors, known in the field as the reference plane.

DETAILED DESCRIPTION OF THE PREFERRED EMBODIMENTS

A large number of home coaxial cable installations are often done by "do-it yourself" laypersons who may not be familiar with such torque standards. In these cases, the installer will typically hand-tighten the coaxial cable connectors instead of using a tool, which can result in the connectors not being properly seated, either upon initial installation, or after a period of use. Upon immediately receiving a poor signal, the customer typically calls the CATV, MSO, satellite or telecommunication provider to request repair service. Obviously, this is a cost concern for the CATV, MSO, satellite and telecommunication providers, who then have to send a repair technician to the customer's home.

Moreover, even when tightened according to the proper torque requirements, another problem with such prior art connectors is the connector's tendency over time to become disconnected from the external device to which it is connected, due to forces such as vibrations, heat expansion, etc. Specifically, the internally threaded nut for providing mechanical attachment of the connector to an external device has a tendency to back-off or loosen itself from the threaded port connection of the external device over time. Once the connector becomes sufficiently loosened, electrical connection between the coaxial cable and the external device is broken, resulting in a failed condition.

Figure 1:
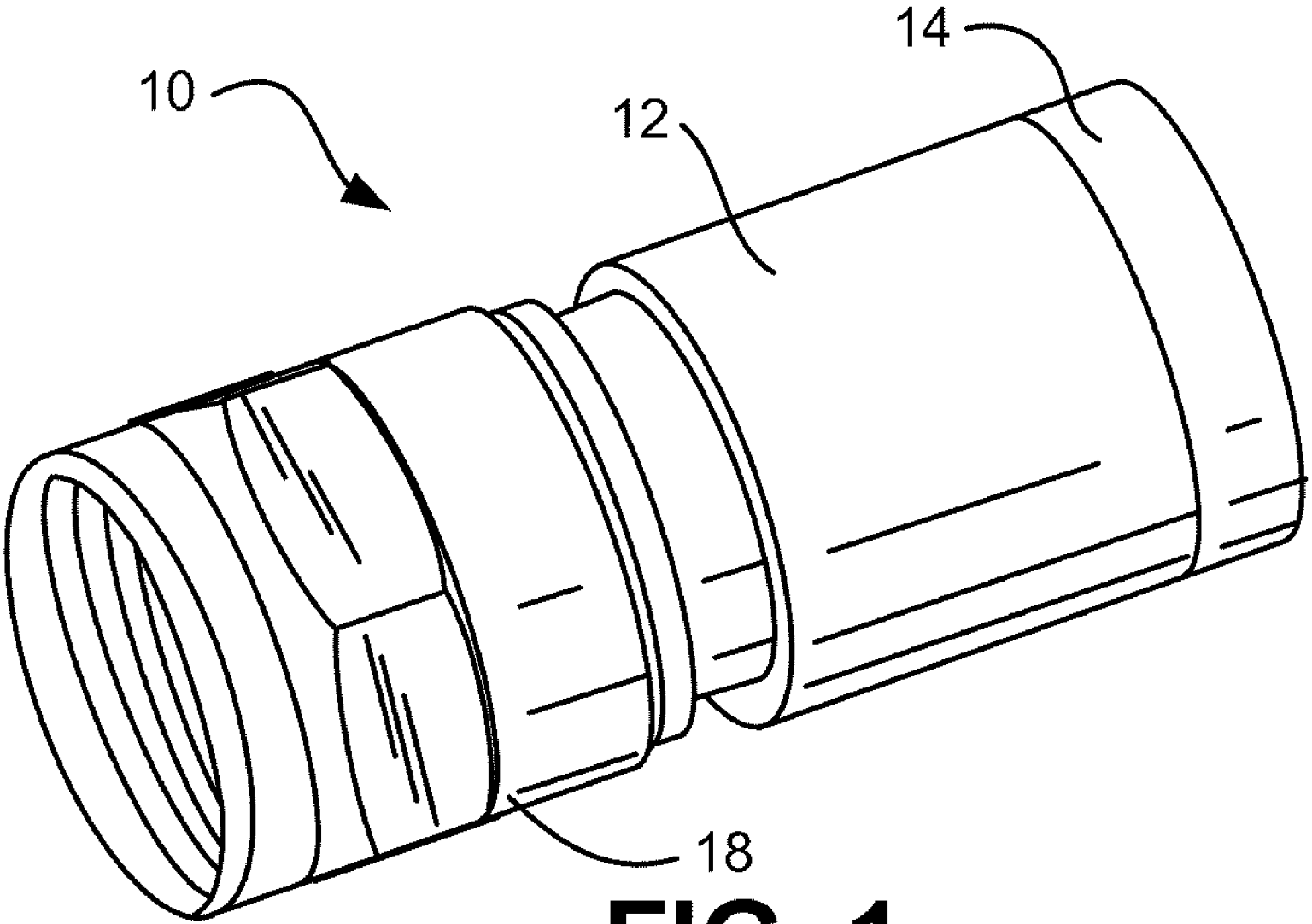
FIG. 1 is an isometric view of an exemplary embodiment of a coaxial cable connector.
Figure 2:
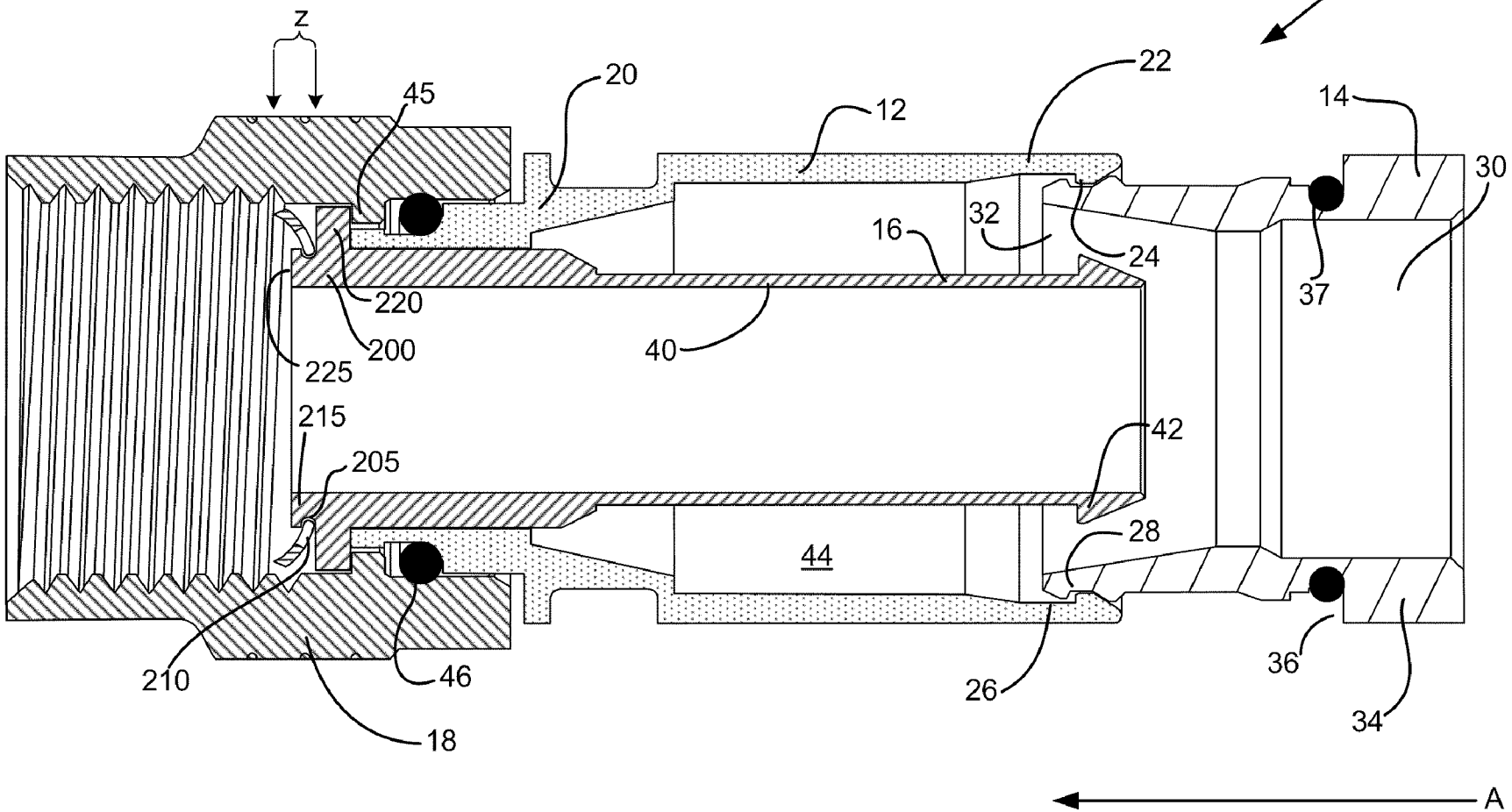
FIG. 2 is a cross-sectional view of the coaxial cable connector of FIG. 1 in an unconnected configuration.
Figure 3:
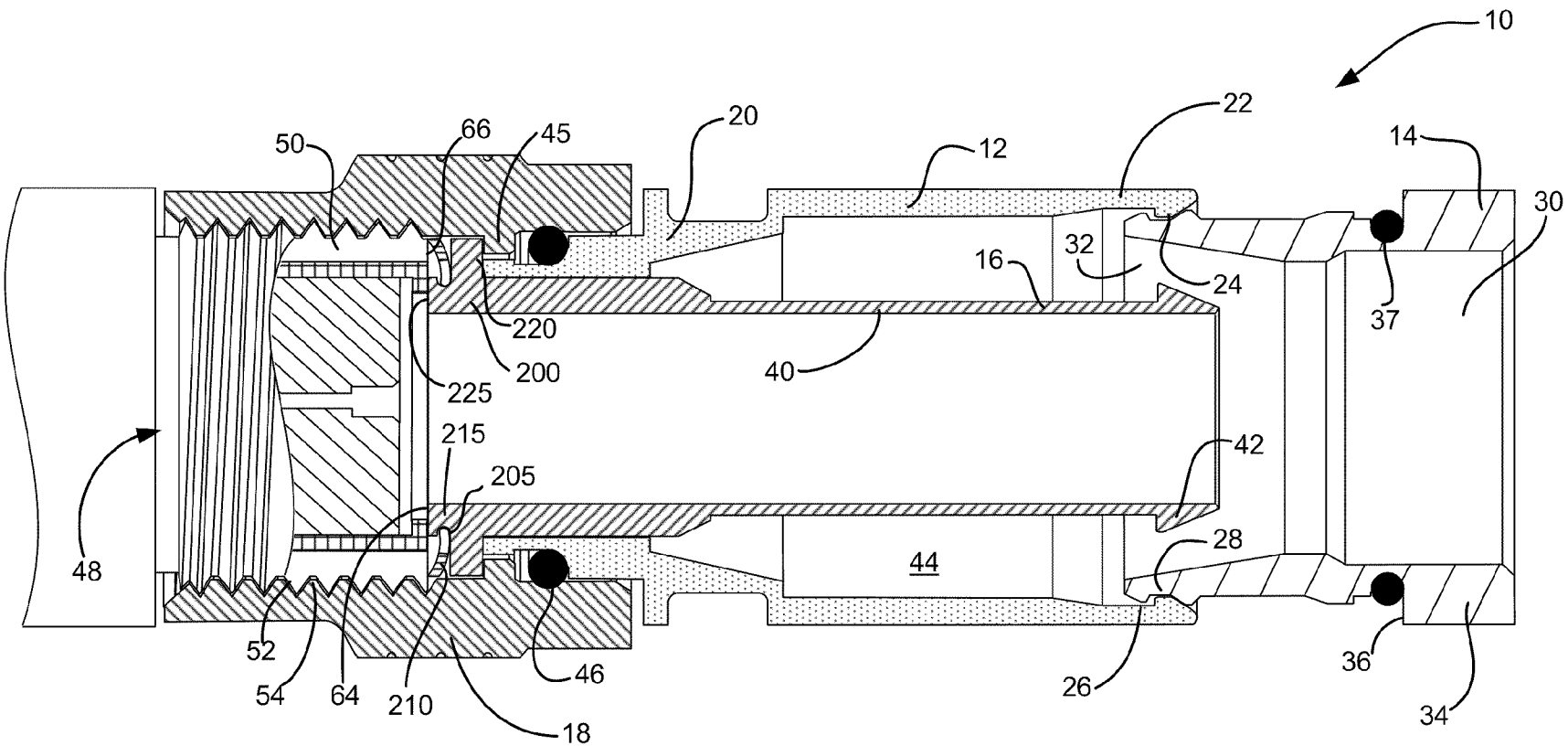
FIG. 3 is a cross-sectional view of the coaxial cable connector of FIG. 2 in a connected configuration.

FIGS. 1-3 depict an exemplary coaxial cable connector 10 consistent with embodiments described herein. As illustrated, connector 10 may include a connector body 12, a locking sleeve 14, an annular post 16, and a rotatable nut 18.

In one implementation, connector body 12 (also referred to as a "collar") may include an elongated, cylindrical member, which can be made from plastic, metal, or any suitable material or combination of materials. Connector body 12 may include a forward end 20 operatively coupled to annular post 16 and rotatable nut 18, and a cable receiving end 22 opposite to forward end 20. Cable receiving end 22 may be configured to insertably receive locking sleeve 14, as well as a prepared end of a coaxial cable in the forward direction as shown by arrow A in FIG. 2. Cable receiving end 22 of connector body 12 may further include an inner sleeve engagement surface 24 for coupling with the locking sleeve 14. In some implementations, inner sleeve engagement surface 24 is preferably formed with a groove or recess 26, which cooperates with mating detent structure 28 provided on the outer surface of locking sleeve 14.

Locking sleeve 14 may include a substantially tubular body having a rearward cable receiving end 30 and an opposite forward connector insertion end 32, movably coupled to inner sleeve engagement surface 24 of the connector body 12. As mentioned above, the outer cylindrical surface of locking sleeve 14 may be configured to include a plurality of ridges or projections 28, which cooperate with groove or recess 26 formed in inner sleeve engagement surface 24 of the connector body 12 to allow for the movable connection of sleeve 14 to the connector body 12, such that locking sleeve 14 is lockingly axially moveable along the direction of arrow A toward the forward end 20 of the connector body from a first position, as shown, for example, in FIG. 2 to a second, axially advanced position (shown in FIG. 1). When in the first position, locking sleeve 14 may be loosely retained in connector 10. When in the second position, locking sleeve 14 may be secured within connector 10. In some implementations, locking sleeve 14 may be detachably removed from connector 10, e.g., during shipment, etc., by, for example, snappingly removing projections 28 from groove/recess 26. Prior to installation, locking sleeve 14 may be reattached to connector body 12 in the manner described above.

In some additional implementations, locking sleeve 14 may include a flanged head portion 34 disposed at the rearward cable receiving end 30 of locking sleeve 14. Head portion 32 may include an outer diameter larger than an inner diameter of the body 12 and may further include a forward facing perpendicular wall 36, which serves as an abutment surface against which the rearward end 22 of body 12 stops to prevent further insertion of locking sleeve 14 into body 12. A resilient, sealing O-ring 37 may be provided at forward facing perpendicular wall 36 to provide a substantially water-tight seal between locking sleeve 14 and connector body 12 upon insertion of the locking sleeve within the body and advancement from the first position (FIG. 2) to the second position (FIG. 1).

As mentioned above, connector 10 may further include annular post 16 coupled to forward end 20 of connector body 12. As illustrated in FIGS. 2 and 3, annular post 16 may include a flanged base portion 200 at its forward end for securing annular post 16 within annular nut 18. Additional details relating to flanged base portion 200 are set forth in additional detail below. Annular post 16 may also include an annular tubular extension 40 extending rearwardly within body 12 and terminating adjacent rearward end 22 of connector body 12. In one embodiment, the rearward end of tubular extension 40 may include a radially outwardly extending ramped flange portion or "barb" 42 to enhance compression of the outer jacket of the coaxial cable and to secure the cable within connector 10. Tubular extension 40 of annular post 16, locking sleeve 14, and connector body 12 together define an annular chamber 44 for accommodating the jacket and shield of an inserted coaxial cable.

As illustrated in FIGS. 1-3, annular nut 18 may be rotatably coupled to forward end 20 of connector body 12. Annular nut 18 may include any number of attaching mechanisms, such as that of a hex nut, a knurled nut, a wing nut, or any other known attaching means, and may be rotatably coupled to connector body 12 for providing mechanical attachment of the connector 10 to an external device via a threaded relationship. As illustrated in FIGS. 2 and 3, nut 18 may include an annular flange 45 configured to fix nut 18 axially relative to annular post 16 and connector body 12. In one implementation, a resilient sealing O-ring 46 may be positioned in annular nut 18 to provide a water resistant seal between connector body 12, annular post 16, and annular nut 18

Connector 10 may be supplied in the assembled condition, as shown in the drawings, in which locking sleeve 14 is pre-installed inside rearward cable receiving end 22 of connector body 12. In such an assembled condition, a coaxial cable may be inserted through rearward cable receiving end 30 of locking sleeve 14 to engage annular post 16 of connector 10 in the manner described above. In other implementations, locking sleeve 14 may be first slipped over the end of a coaxial cable and the cable (together with locking sleeve 14) may subsequently be inserted into rearward end 22 of connector body 12.

In either case, once the prepared end of a coaxial cable is inserted into connector body 12 so that the cable jacket is separated from the insulator by the sharp edge of annular post 16, locking sleeve 14 may be moved axially forward in the direction of arrow A from the first position (shown in FIGS. 2 and 3) to the second position (shown in FIG. 1). In some implementations, advancing locking sleeve 14 from the first position to the second position may be accomplished with a suitable compression tool. As locking sleeve 14 is moved axially forward, the cable jacket is compressed within annular chamber 44 to secure the cable in connector 10. Once the cable is secured, connector 10 is ready for attachment to a port connector 48 (illustrated in FIG. 3), such as an F-81 connector, of an external device.

As illustrated in FIG. 3, port connector 48 may include a substantially cylindrical body 50 having external threads 52 that match internal threads 54 of annular nut 18. As will be discussed in additional detail below, retention force between annular nut 18 and port connector 48 may be enhanced by providing a substantially constant load force on the port connector 48.

To provide this load force, flanged base portion 200 of annular post 16 may be configured to include an annular notch 205 for retaining a biasing element 210. As illustrated in FIGS. 2 and 3, flanged base portion 200 may include a step configuration including a first annular step portion 215 and a second annular step portion 220. First annular step portion 215 may further include a forward, substantially planar surface 225, that defines an end of annular post 16. In one implementation, annular notch 205 may include an annular groove formed in an outer surface of first annular step portion 215.

Biasing element 210 may include a conductive, resilient element configured to provide a suitable biasing force between annular post 16 and rearward surface 66 of port connector 48. The conductive nature of biasing element 210 may facilitate passage of electrical and radio frequency (RF)

signals from annular post 16 to port connector 48 at varying degrees of insertion relative to port connector 48 and connector 10.

In one implementation, biasing element 210 may include one or more coil springs, one or more wave springs (single or double waves), one or more a conical spring washers (slotted or unslotted), one or more Belleville washers, or any other suitable biasing element, such as a conductive resilient element (e.g., a plastic or elastomeric member impregnated or injected with conductive particles), etc.

Figure 8B:
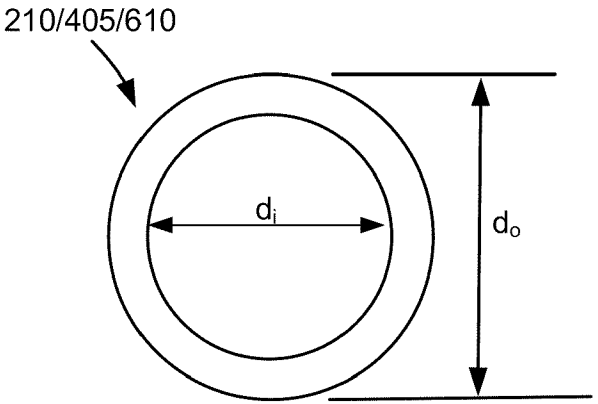
FIGS. 8A-8C illustrate an exemplary biasing element consistent with an exemplary embodiment.
Figure 8A:
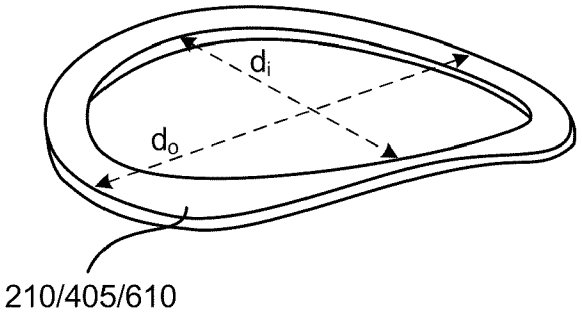
Figure 8C:
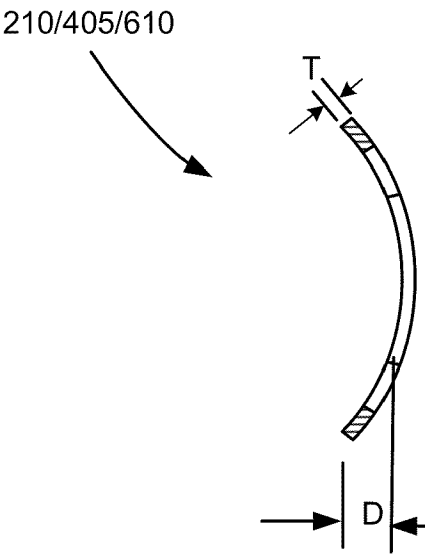

As illustrated in FIGS. 8A-8C, biasing element 210 may include a two-peak wave washer having an inside diameter "$d_i$" and an outside diameter "$d_o$." In one implementation, the inside diameter $d_i$ of biasing element 210 may be sized substantially similarly to a diameter of annular notch 205, such that biasing element 210 may be retained within annular notch 205. In one configuration (not shown), a forward edge of first annular step portion 215 may be configured to include a beveled or chamfered surface for facilitating insertion of biasing element 210 into annular notch 205.

In an initial, uncompressed state (as shown in FIG. 2), biasing element 210 may extend a length "z" beyond forward surface 64 of annular post 16. Upon insertion of port connector 48 (e.g., via rotatable threaded engagement between threads 52 and threads 54 as shown in FIG. 3), rearward surface 66 of port connector 48 may come into contact with biasing element 210. In a position of initial contact between port connector 48 and biasing element 210 (not shown), rearward surface 66 of port connector 48 may be separated from forward surface 64 of annular post 16 by a distance "z." The conductive nature of biasing element 210 may enable effective transmission of electrical and RF signals from port connector 48 to annular post 16 even when separated by distance z, effectively increasing the reference plane of connector 10. In one implementation, the above-described configuration enables a functional gap or "clearance" of less than or equal to approximately 0.043 inches, for example 0.033 inches, between the reference planes, thereby enabling approximately 270 degrees or more of "back-off" rotation of annular nut 18 relative to port connector 48 while maintaining suitable passage of electrical and/or RF signals.

Continued insertion of port connector 48 into connector 10 may cause biasing element 210 to compress, thereby providing a load force between flanged base portion 200 and port connector 48 and decreasing the distance between rearward surface 66 of port connector 48 and forward surface 64 of annular post 16. This load force may be transferred to threads 52 and 54, thereby facilitating constant tension between threads 52 and 54 and facilitating a decreased likelihood that port connector 48 becomes loosened from connector 10 due to external forces, such as vibrations, heating/cooling, etc.

The above-described connector may pass electrical and RF signals typically found in CATV, Satellite, closed circuit television (CCTV), voice of Internet protocol (VoIP), data, video, high speed Internet, etc., through the mating ports (about the connector reference planes). Providing a biasing element, as described above, may also provide power bonding grounding (i.e., helps promote a safer bond connection per NEC® Article 250 when biasing element 58 is under linear compression) & RF shielding (Signal Ingress & Egress).

Upon installation, the annular post 16 may be incorporated into a coaxial cable between the cable foil and the cable braid and may function to carry the RF signals propagated by the coaxial cable. In order to transfer the signals, post 16 makes contact with the reference plane of the mating connector (e.g., port connector 48). By retaining biasing element 210 in notch 205 in annular post 16, biasing element 210 is able to ensure electrical and RF contact at the reference plane of port connector 48. The stepped nature of post 16 enables compression of biasing element 210, while simultaneously supporting direct interfacing between post 16 and port connector 48. Further, compression of biasing element 210 provides equal and opposite biasing forces between the internal threads of nut 18 and the external threads of port connector 48.

Figure 4:
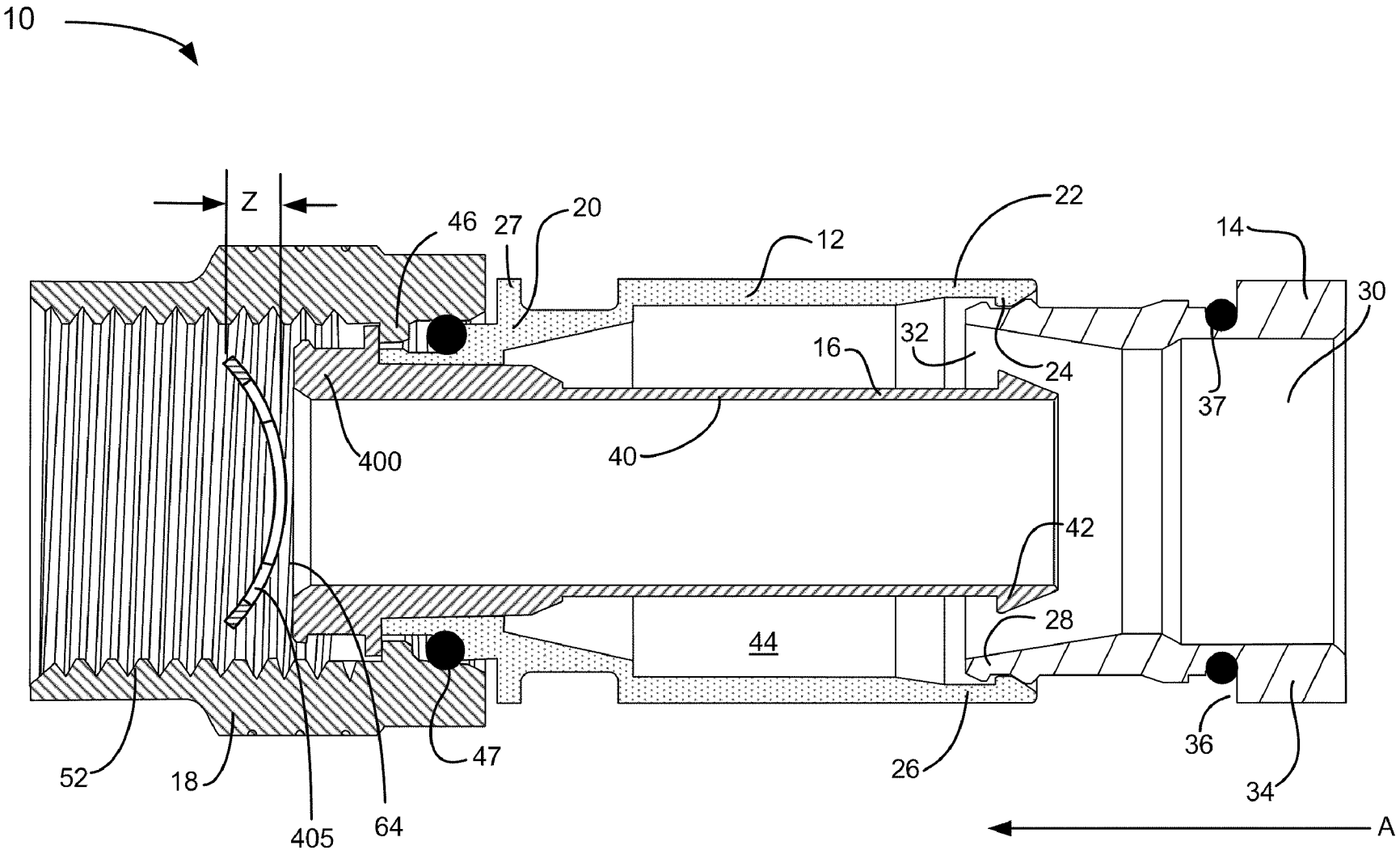
FIG. 4 is a cross-sectional view of another exemplary embodiment of the coaxial cable connector of FIG. 1 in an unconnected configuration.
Figure 5:
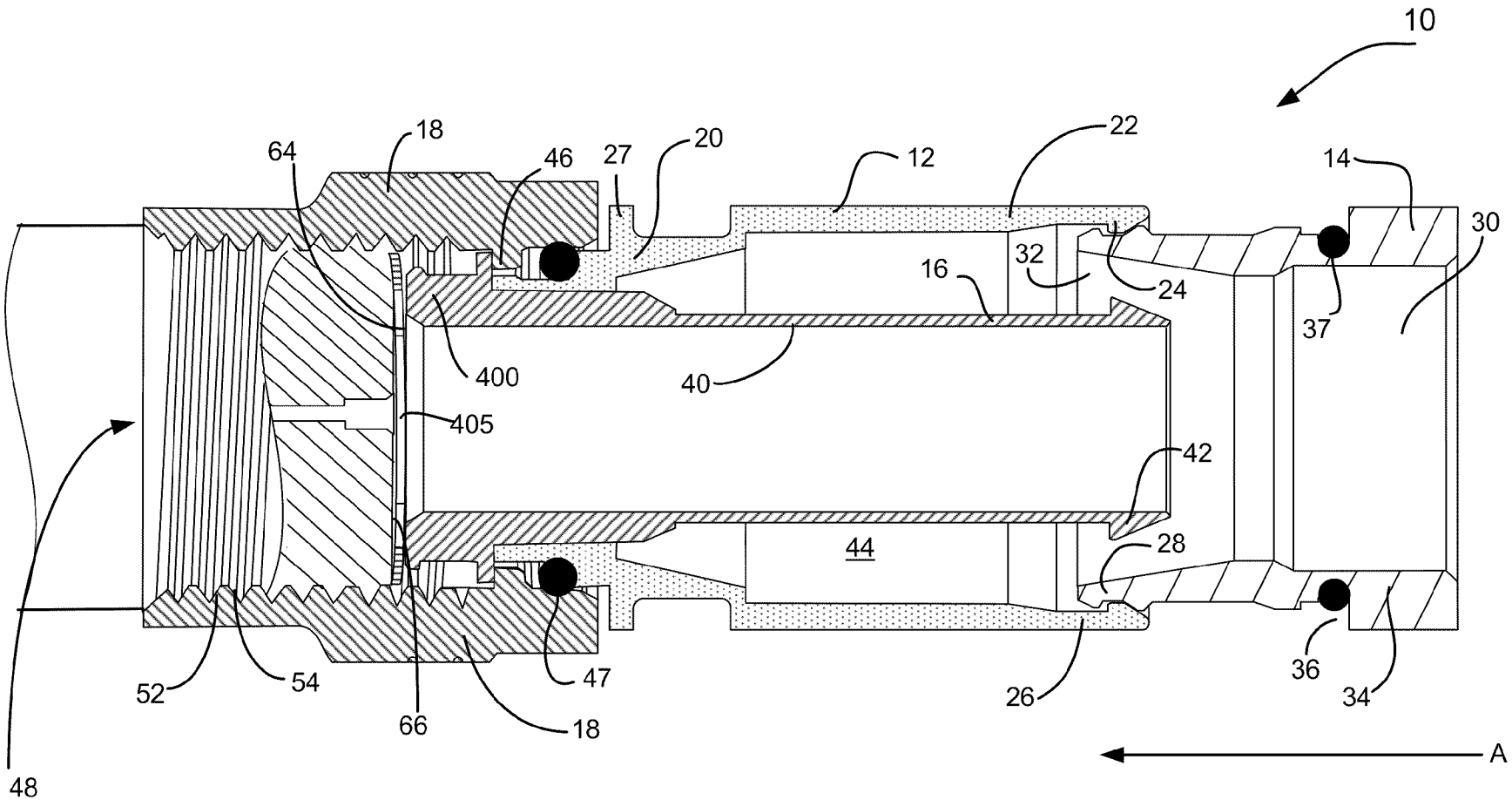
FIG. 5 is a cross-sectional view of the coaxial cable connector of FIG. 4 in a connected configuration.

Referring now to FIGS. 4 and 5, an alternative implementation of a forward portion of connector 10 is shown. As illustrated in FIGS. 4 and 5, annular post 16 may include a flanged base portion 400 at its forward end for securing annular post 16 within annular nut 18. A biasing element 405 may include one or more wave washers or wave springs (single or double wave), one or more coil springs, one or more conical spring washers (slotted or unslotted), one or more Belleville washers, or any other suitable biasing element, such as a conductive resilient component (e.g., a plastic or elastomeric member impregnated or injected with conductive particles), etc. As illustrated in FIG. 8A, in one implementation, biasing element 405 may include a two-peak wave washer having an inside diameter $d_i$ and an outside diameter $d_o$. In an exemplary implementation, the inside diameter $d_i$ of biasing element 405 may be sized substantially similar to an opening extending through annular post 16 and the outside diameter $d_o$ may be less than the outside diameter of threads 52. In this manner, a coaxial conductor element from an inserted coaxial cable (e.g., coaxial cable 100) may extend through biasing element 405.

As discussed above, in one implementation, biasing element 405 may be a wave washer, such as the wave washer illustrated in FIG. 8A. In an exemplary implementation, biasing element 405 may be fabricated using spring steel having a thickness of approximately 0.012 inches, with $d_i$ being approximately 0.225 inches±0.003 inches and $d_o$ being approximately 0.300 inches±0.003 inches. FIG. 8B illustrates a top view of biasing element 405. It should be understood that other sized biasing elements 405 may be used in other implementations based on the particular dimensions associated with connector 10. In one implementation, when biasing element 405 is a wave washer having a thickness of 0.012 inches, biasing element may exert a spring force of approximately 6.5 lbs±0.9 lbs at a 0.030 inch deflection. For example, referring to the cross-section of biasing element 405 in FIG. 8C, when T is 0.012 inches, and biasing element 405 is compressed or deformed such that D is 0.030 inches (from a reference or maximum deflection of 0.048 inches), biasing element 405 may exert a spring force of 6.5 lbs±0.9 lbs. The conductive nature of biasing element 405 may also enable effective transmission of electrical and radio frequency (RF) signals from annular post 16 to port connector 48, at varying degrees of insertion relative to port connector 48 and connector 10, as described in more detail below.

As discussed above, in one embodiment, biasing element 405 may include a wave washer that is sized to easily fit inside the front surface of nut 18. This may allow an installer to simply insert biasing element 405 into connector 10 (e.g., inside the inner portion of nut 18 adjacent threads 52) prior to installing connector 10 onto port connector 48.

In an initial, uncompressed state (as shown in FIG. 4), biasing element 405 may extend a length "z" beyond the forward end of forward surface of flanged base portion 400. Upon insertion of port connector 48 (e.g., via rotatable threaded engagement between threads 52 of connector 10 and threads 54 of port connector 48 as shown in FIG. 3), rearward surface 66 of port connector 48 may come into contact with biasing element 405. In a position of initial contact between port connector 48 and biasing element 405 (not shown in FIG.

3), rearward surface 66 of port connector 48 may be separated from forward surface 64 of annular post 16 by the distance "z." The conductive nature of biasing element 405 may enable effective transmission of electrical and RF signals from port connector 48 to annular post 16 even when separated by distance z, effectively increasing the reference plane of connector 10. In one implementation, the above-described configuration enables a functional gap or "clearance" between the reference plane of connector 10 with respect to port connector 48, thereby enabling approximately 360 degrees or more of "back-off" rotation of nut 18 relative to port connector 48, while maintaining suitable passage of electrical and RF signals from annular post 16 to port connector 48.

Continued insertion of port connector 48 into connector 10 may cause biasing element 405 to compress, as illustrated in FIG. 5, thereby providing a load force between flanged base portion 400 and port connector 48 and decreasing the distance between rearward surface 66 of port connector 48 and forward surface 64 of annular post 16. In this state, a greater portion of biasing element 405 is in electrical contact with the front surface of annular post 16 than when biasing element 405 is in the uncompressed state. The compression of biasing element 405 provides a load or spring force between flanged base portion 400 and port connector 48. This load force is transferred to threads 52 and 54, thereby facilitating constant tension between threads 52 and 54 and causing a decreased likelihood that port connector 48 becomes loosened from connector 10 due to external forces, such as vibrations, heating/cooling, etc. That is, should nut 18 loosen and the rearward face 66 of port connector 48 begins to back away from the forward face 64 of annular post 16, the resilience of biasing element 405 will urge biasing element 405 to spring back to its initial form so that biasing element 405 will maintain electrical and RF contact with the rearward face 66 of port connector 48.

The above-described connector may pass electrical and RF signals typically found in CATV, satellite, closed circuit television (CCTV), voice over Internet protocol (VoIP), data, video, High Speed Internet, etc., through the mating ports (about the connector reference planes). Providing a biasing element, as described above, may also provide power bonding grounding (i.e., help promote a safer bond connection per NEC® Article 250 when biasing element 58 is under linear compression) and RF shielding (Signal Ingress & Egress).

Upon installation, annular post 16 may be incorporated into a coaxial cable between the cable foil and the cable braid and may function to carry the RF signals propagated by the coaxial cable. In order to transfer the signals, annular post 16 makes contact with the reference plane of the mating connector (e.g., port connector 48). By inserting biasing element 405 into the front portion of connector 10 (e.g., inside nut 18) prior to coupling connector 10 to port connector 48, biasing element 405 is able to ensure electrical and RF contact at the reference plane of port connector 48 at various distances with respect to annular post 16, while simultaneously requiring minimal to no additional structural elements with respect to connector 10. Therefore, by providing biasing element 405 prior to installation of connector 10 to port connector 48, connector 10 may allow for up to 360 degrees or more of "back-off" rotation of nut 18 with respect to port connector 48. In other words, biasing element 405 helps to maintain electrical and RF continuity between annular post 16 and port connector 48 even if nut 18 is partially loosened. As a result, maintaining electrical and RF contact between coaxial cable connector 10 and port connector 48 may be significantly improved as compared to prior art connectors. Further, compression of biasing element 405 provides equal and opposite biasing forces between internal threads 52 of nut 18 and external threads 54 of port connector 48, thereby reducing the likelihood of back-off due to environmental factors.

Figure 6:
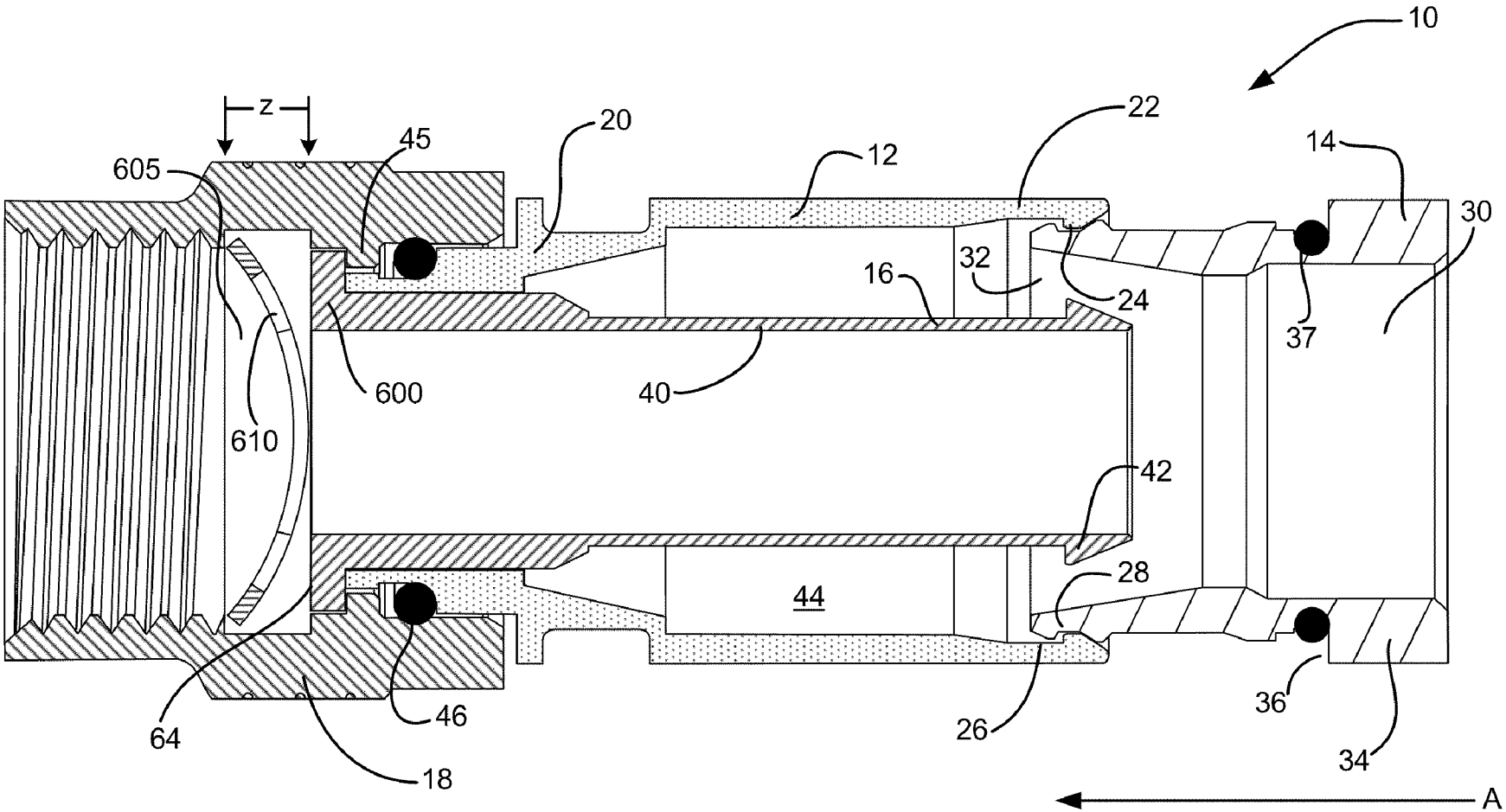
FIG. 6 is a cross-sectional view of another exemplary implementation of the coaxial cable connector of FIG. 1 in an unconnected configuration.
Figure 7:
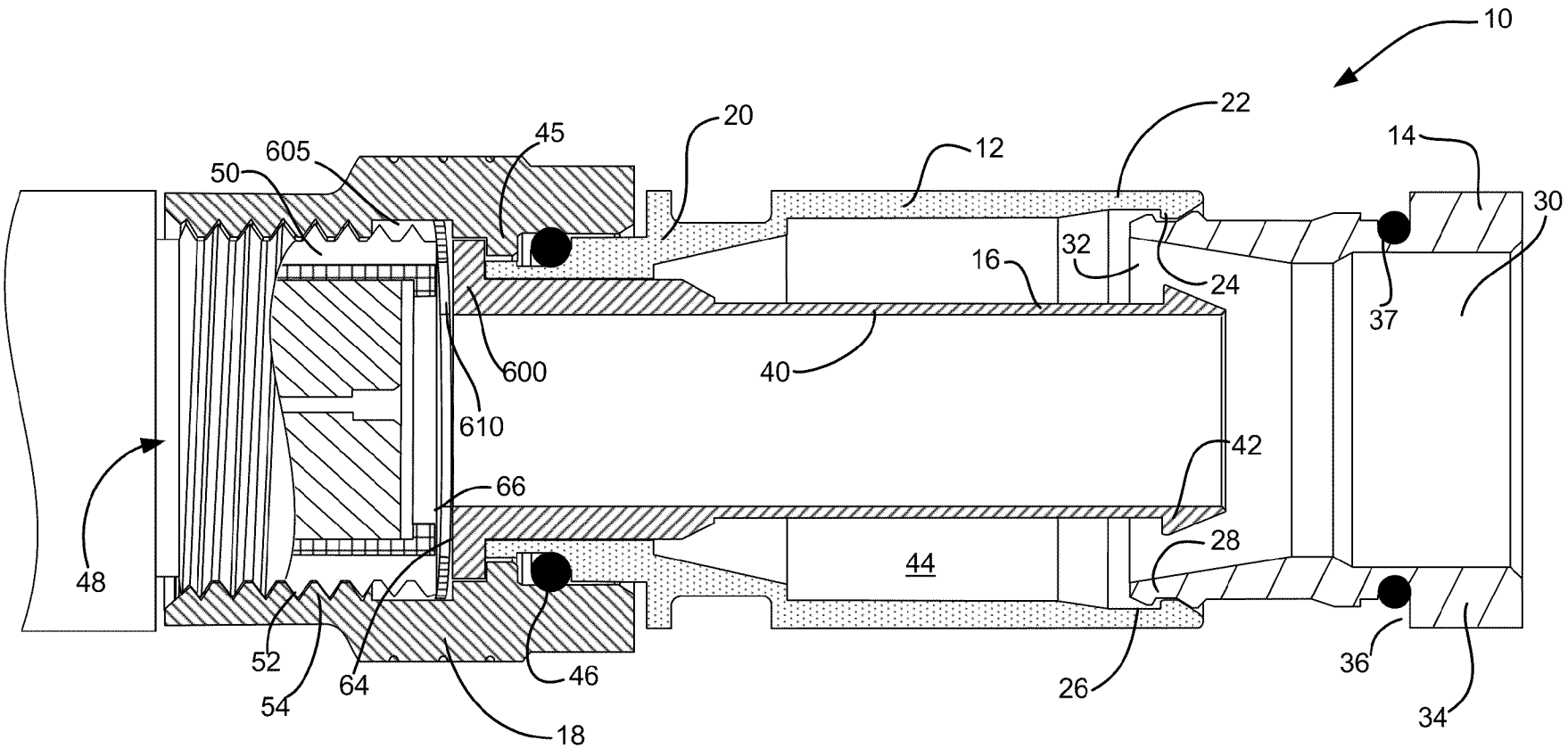
FIG. 7 is a cross-sectional view of the coaxial cable connector of FIG. 6 in a connected configuration.

Referring now to FIGS. 6 and 7, an alternative implementation of a forward portion of connector 10 is shown. As illustrated in FIGS. 6 and 7, annular post 16 may include a flanged base portion 600. Further, an internal diameter of annular nut 18 may be notched to form a substantially cylindrical cavity 605 within nut 18. As illustrated in FIGS. 6 and 7, cavity 605 may be bounded on a rearward side by the forward surface of flanged base portion 600. An outer diameter of annular cavity 605 may be larger than an inner diameter of internal threads 54 of nut 18.

Consistent with embodiments described herein, a biasing element 610 may be positioned within cavity 605 adjacent the forward surface of base portion 600. In one implementation, biasing element 610 may have an outside diameter greater than the inside diameter of threads 54 but less than the outside diameter of cavity 605. This size effectively retains biasing element 610 within cavity 605 upon assembly of connector 10.

Biasing element 610 may include a conductive, resilient element configured to provide a suitable biasing force between forward surface 64 of annular post 16 and rearward surface 66 of port connector 48, upon insertion of the female port connector 48 into male coaxial connector 10. The conductive nature of biasing element 610 may facilitate passage of electrical and radio frequency (RF) signals from annular post 16 to port connector 48 at varying degrees of insertion relative to port connector 48 and male coaxial connector 10.

In one implementation, biasing element 610 may include one or more coil springs, one or more wave springs (single or double waves), one or more a conical spring washers (slotted or unslotted), one or more Belleville washers, or any other suitable biasing element, such as a conductive resilient element (e.g., a plastic or elastomeric member impregnated or injected with conductive particles), etc.

As illustrated in FIGS. 8A-8C, biasing element 610 may include a two-peak wave washer having an inside diameter "$d_i$" and an outside diameter "$d_o$." In one implementation, the inside diameter $d_i$ of biasing element 610 may be sized substantially similarly to an opening extending through annular post 16, such that a coaxial conductor element from an inserted coaxial cable may extend through biasing element 610.

In an initial, uncompressed state (as shown in FIG. 7), biasing element 610 may extend a length "z" beyond the forward end of base portion 600. Upon insertion of port connector 48 (e.g., via rotatable threaded engagement between threads 52 and threads 54 as shown in FIG. 5), rearward surface 66 of port connector 48 may engage and compress biasing element 610. In a position of initial contact between port connector 48 and biasing element 610 (not shown In FIG. 4), rearward surface 66 of port connector 48 may be separated from the forward surface 64 of annular post 16 by the distance "z." The conductive nature of biasing element 610 may enable effective transmission of electrical and RF signals from annular post 16 to port connector 48 even when separated by distance z, effectively increasing the reference plane of connector 10. In one implementation, the above-described configuration enables a functional gap or "clearance" between the reference planes, thereby enabling approximately 360 degrees of "back-off" rotation of annular nut 18 relative to port connector 48 while maintaining suitable passage of electrical and RF signals from annular post 16 to port connector 48.

Continued insertion of port connector 48 into connector 10 may cause biasing element 610 to compress, thereby reducing the axial distance between port connector 48 and annular post 16. The compression of biasing element 610 provides a load force between flanged base portion 600 and port connector 48. This load force is transferred to threads 52 and 54, thereby facilitating constant tension between threads 52 and 54 and causing a decreased likelihood that port connector 48 becomes loosened from connector 10 due to external forces, such as vibrations, heating/cooling, etc.

The above-described connector embodiments may pass electrical and RF signals typically found in CATV, Satellite, closed circuit television (CCTV), voice of Internet protocol (VoIP), data, video, high speed Internet, etc., through the mating ports (about the connector reference planes). Providing a biasing element, as described above, may also provide power bonding grounding (i.e., helps promote a safer bond connection per NEC® Article 250 when biasing element 58 is under linear compression) & RF shielding (Signal Ingress & Egress).

Upon installation, the annular post 16 may be incorporated into a coaxial cable between the cable foil and the cable braid and may function to carry the RF signals propagated by the coaxial cable. In order to transfer the signals, annular post 16 makes contact with the reference plane of the mating connector (e.g., port connector 48). By retaining electrically conductive biasing element 610 in cavity 605, biasing element 610 ensures electrical and RF contact at the reference plane of port connector 48 at various distances with respect to annular post 16, while simultaneously requiring minimal additional structural elements and manufacturing modifications. Further, compression of biasing element 610 provides equal and opposite biasing forces between internal threads 54 of nut 18 and external threads 52 of port connector 48, thereby reducing a likelihood of back-off due to environmental factors.

The foregoing description of exemplary implementations provides illustration and description, but is not intended to be exhaustive or to limit the embodiments described herein to the precise form disclosed. Modifications and variations are possible in light of the above teachings or may be acquired from practice of the embodiments.

For example, various features have been mainly described above with respect to a coaxial cables and connectors for securing coaxial cables. In other implementations, features described herein may be implemented in relation to other cable or interface technologies. For example, the coaxial cable connector described herein may be used or usable with various types of coaxial cable, such as 50, 75, or 93 ohm coaxial cable, or other characteristic impedance cable designs.

Although the invention has been described in detail above, it is expressly understood that it will be apparent to persons skilled in the relevant art that the invention may be modified without departing from the spirit of the invention. Various changes of form, design, or arrangement may be made to the invention without departing from the spirit and scope of the invention. Therefore, the above mentioned description is to be considered exemplary, rather than limiting, and the true scope of the invention is that defined in the following claims.

No element, act, or instruction used in the description of the present application should be construed as critical or essential to the invention unless explicitly described as such. Also, as used herein, the article "a" is intended to include one or more items. Where only one item is intended, the term "one" or similar language is used. Further, the phrase "based on" is intended to mean "based, at least in part, on" unless explicitly stated otherwise.

What is claimed is:

1. A coaxial cable connector for coupling a coaxial cable to a mating connector, the coaxial cable connector comprising:

a connector body having a forward end and a rearward cable receiving end for receiving a cable;

a nut rotatably coupled to the forward end of the connector body;

an annular post disposed within the connector body, the annular post having a forward flanged base portion located adjacent a rearward portion of the nut;

an annular notch formed in the forward flanged base portion; and a biasing element retained in the annular notch, wherein the biasing element extends towards a forward end of the nut in an uncompressed state.

2. The coaxial cable connector of claim 1, wherein the biasing element comprises a compression spring, a wave spring, a conical spring washer, Belleville washer, or a conductive resilient element.

3. The coaxial cable connector of claim 1, wherein the biasing element is electrically conductive.

4. The coaxial cable connector of claim 1, wherein the forward flanged base portion has a step configuration including a first annular step portion formed in a forward portion of the forward flanged base portion, and a second annular step portion formed rearward of the first annular step portion, and wherein the annular notch is formed in the second annular step portion.

5. The coaxial cable connector of claim 4, wherein the annular notch comprises an annular groove formed in the second annular step portion, and wherein the biasing element is retained in the annular groove.

6. The coaxial cable connector of claim 1, wherein the biasing element is configured to compress toward the forward flanged base portion upon axial insertion of a port connector into the nut.

7. A coaxial cable connector configured to connect with a mating connector having a rearward surface, the coaxial cable connector comprising:

a connector body having a forward end and a rearward cable receiving end for receiving a cable;

a nut rotatably coupled to the forward end of the connector body;

an annular post disposed within the connector body, the annular post having a forward flanged base portion located adjacent a rearward portion of the nut;

an annular notch formed in the forward flanged base portion; and a biasing element retained in the annular notch, wherein the biasing element is configured to be compressed between the rearward surface of the mating connector and the forward flanged base portion of the annular post.

8. The coaxial cable connector of claim 7, wherein the biasing element comprises a compression spring, a wave spring, a conical spring washer, a Belleville washer, or a conductive resilient element.

9. The coaxial cable connector of claim 7, wherein the mating connector includes a substantially cylindrical body having a number of external threads, and wherein the nut includes a number of internal threads for engaging the external threads of the mating connector, and wherein compression of the biasing element induces a spring load force between the internal threads and the external threads.

10. A method, comprising:

providing a coaxial cable connector configured to connect a coaxial cable to a second connector, the coaxial cable connector comprising:

a connector body having a forward end and a rearward end, the forward end being configured to connect to the second connector and the rearward end configured to receive the coaxial cable, a nut rotatably coupled to the forward end of the connector body, and an annular post disposed within the connector body; inserting a biasing element inside the nut, wherein at least a portion of the biasing element contacts the annular post when the biasing element is in an uncompressed state; and coupling the coaxial cable connector to the second connector, wherein during the coupling, the biasing element is compressed.

11. The method of claim 10, wherein the coupling comprises:

screwing the nut of the coaxial cable connector onto the second connector, the second connector having external threads that mate with internal threads of the nut, and wherein when the nut is tightened, a larger portion of the biasing element directly contacts the annular post than when the biasing element is in the uncompressed state.

12. The method of claim 11, wherein the biasing element imparts a biasing force ranging from about 5.5 to about 7.5 pounds of force when the biasing element is compressed about 0.03 inches from its free or uncompressed length.

13. The method of claim 10, wherein the biasing element comprises a wave washer.

14. A connector configured to couple with a coaxial cable and mate with a mating connector, the connector comprising:

a connector body having a forward end and a rearward end, the forward end being configured to connect to the mating connector and the rearward end configured to receive the coaxial cable, a nut rotatably coupled to the forward end of the connector body, wherein the wave washer is configured to be inserted inside the nut prior to connection of the connector to the mating connector, and an annular post disposed within the connector body, the annular post contacting a portion of the wave washer.

15. The connector of claim 14, wherein the wave washer is configured to provide electrical and radio frequency connectivity from the annular post to the mating connector when the connector is loosened with respect to the mating connector.

16. A male coaxial cable connector for coupling a coaxial cable to a mating female coaxial cable connector, the male coaxial cable connector comprising:

a connector body having a forward end and a rearward cable receiving end for receiving a cable;

an annular post disposed within the connector body, the annular post having a forward flanged base portion located at a forward end, a nut rotatably coupled to the forward end of the connector body, the nut having a forward portion for attachment to the female coaxial cable connector, and a rearward portion adjacent the forward flanged base portion, wherein the nut includes an annular notch rearwardly adjacent the forward portion, where the annular notch has an inside diameter greater than an inside diameter of the forward portion of the nut; and a biasing element positioned in the annular notch between the forward flanged base portion and the forward portion of the nut.

17. The male coaxial cable connector of claim 16, wherein the biasing element comprises a compression spring, a wave spring, a conical spring washer, a Belleville washer, or a conductive resilient element.

18. The male coaxial cable connector of claim 16, wherein the nut includes an inwardly directed flange in the rearward portion that engages the annular post and retains the nut in an axially fixed position relative to the annular post.

19. The male coaxial cable connector of claim 16, wherein the biasing element is electrically conductive.

20. The male coaxial cable connector of claim 16, wherein the annular notch forms a cavity in the nut, the cavity bounded on a rearward side by the forward flanged base portion of the annular post, and on a forward side by a rearward facing surface of the forward portion of the nut exposed by the annular notch, and wherein the biasing element is positioned in the cavity.

21. The male coaxial cable connector of claim 16, wherein the biasing element is configured to compress toward the forward flanged base portion upon axial insertion of the female coaxial cable connector into the nut.

22. A male coaxial cable connector configured to connect to a female coaxial cable connector having a rearward surface, the male coaxial cable connector comprising:

a connector body having a forward end and a rearward cable receiving end for receiving a cable;

an annular post disposed within the connector body, the annular post having a forward flanged base portion located at a forward end, a nut rotatably coupled to the forward end of the connector body, the nut having a forward portion for attachment to the female coaxial cable connector, and a rearward portion adjacent the forward flanged base portion, wherein the nut includes an annular notch rearwardly adjacent the forward portion, where the annular notch has a inside diameter greater than an inside diameter of the forward portion forming a rearward surface of the forward portion of the nut; and a biasing element positioned in the annular notch between the forward flanged base portion and the rearward surface of the forward portion of the nut, wherein the biasing element is configured to be compressed between the rearward surface of the female coaxial cable connector and the forward flanged base portion of the annular post upon movement of the female coaxial cable connector into the nut.

23. The male connector of claim 22, wherein the biasing element comprises a compression spring, a wave spring, a conical spring washer, a Belleville washer, or a conductive resilient element.

24. The male connector of claim 22, wherein the female coaxial cable connector includes a substantially cylindrical body having a number of external threads, and wherein the forward portion of the nut includes a number of internal threads for engaging the external threads of the female coaxial cable connector, and wherein compression of the biasing element induces a spring load force between the internal threads of the nut and the external threads of the female coaxial cable connector.

* * * * *